US008070591B2

(12) United States Patent
Fiden

(10) Patent No.: US 8,070,591 B2
(45) Date of Patent: Dec. 6, 2011

(54) GAMING MACHINE WITH SCROLLING INDICIA FEATURE

(75) Inventor: Daniel P. Fiden, Half Moon Bay, CA (US)

(73) Assignee: WMS Gaming Inc., Waukegan, IL (US)

( * ) Notice: Subject to any disclaimer, the term of this patent is extended or adjusted under 35 U.S.C. 154(b) by 559 days.

(21) Appl. No.: 12/199,403

(22) Filed: Aug. 27, 2008

(65) Prior Publication Data

US 2008/0318665 A1 Dec. 25, 2008

Related U.S. Application Data

(63) Continuation of application No. 10/308,671, filed on Dec. 3, 2002, now Pat. No. 7,435,175.

(51) Int. Cl.
*A63F 9/24* (2006.01)

(52) U.S. Cl. ..... 463/20; 463/16; 463/25

(58) Field of Classification Search ..... 463/16–20, 463/25

See application file for complete search history.

(56) References Cited

U.S. PATENT DOCUMENTS

| | | | | |
|---|---|---|---|---|
| 4,363,489 | A | 12/1982 | Chodak et al. | 273/237 |
| 4,695,053 | A | 9/1987 | Vazquez et al. | 463/18 |
| 5,205,555 | A | 4/1993 | Hamano | 273/143 R |
| 5,788,573 | A | 8/1998 | Baerlocher et al. | 463/16 |
| 5,823,874 | A | 10/1998 | Adams | 463/17 |
| 5,848,932 | A | 12/1998 | Adams | 463/20 |
| 5,947,820 | A | 9/1999 | Morro et al. | 463/9 |
| 6,027,115 | A | 2/2000 | Griswold et al. | 273/143 R |
| 6,168,520 | B1 | 1/2001 | Baerlocher et al. | 463/16 |
| 6,186,894 | B1 | 2/2001 | Mayeroff | 463/20 |
| 6,190,255 | B1 | 2/2001 | Thomas et al. | 463/20 |
| 6,315,660 | B1 | 11/2001 | DeMar et al. | 463/16 |
| 6,319,124 | B1 | 11/2001 | Baerlocher et al. | 463/20 |
| 6,398,218 | B1 | 6/2002 | Vancura | 273/138.1 |
| 6,413,162 | B1 | 7/2002 | Baerlocher et al. | 463/20 |
| 6,634,945 | B2 | 10/2003 | Glavich et al. | 463/25 |
| D487,582 | S | 3/2004 | McGahn et al. | D21/369 |
| 2002/0187827 | A1* | 12/2002 | Blankstein | 463/20 |

* cited by examiner

*Primary Examiner* — Omkar Deodhar

(74) *Attorney, Agent, or Firm* — Nixon Peabody LLP

(57) ABSTRACT

A gaming machine for conducting a wagering game includes a wagering apparatus, a display, and an award apparatus. The wagering apparatus receives a wager from a player. The display depicts a scrolled sequence of elements. The award apparatus provides an award based on an indicated portion of the sequence of elements. If the elements are digits, for example, the award may be based on a multi-digit number formed by the digits in the indicated portion of the sequence of elements.

25 Claims, 4 Drawing Sheets

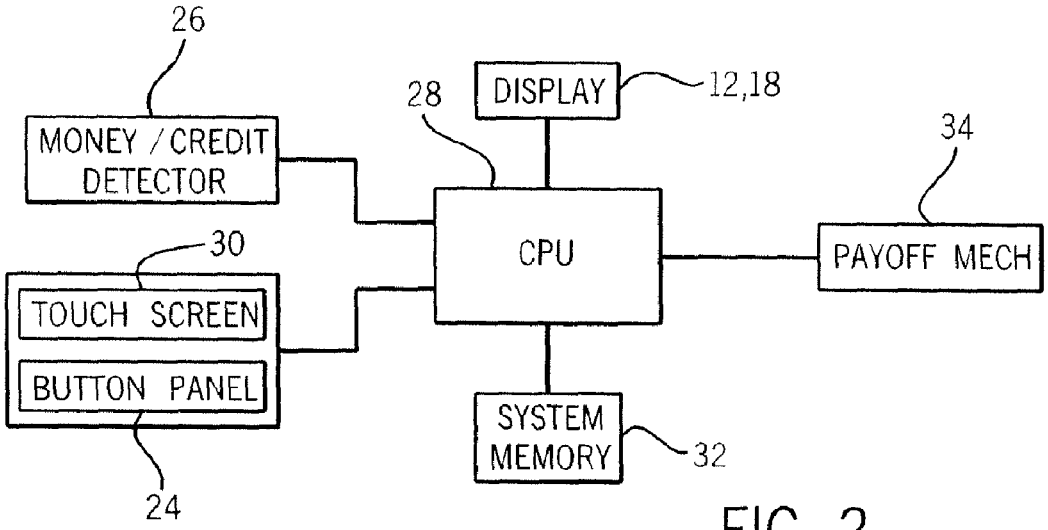
FIG. 2
FIG. 3
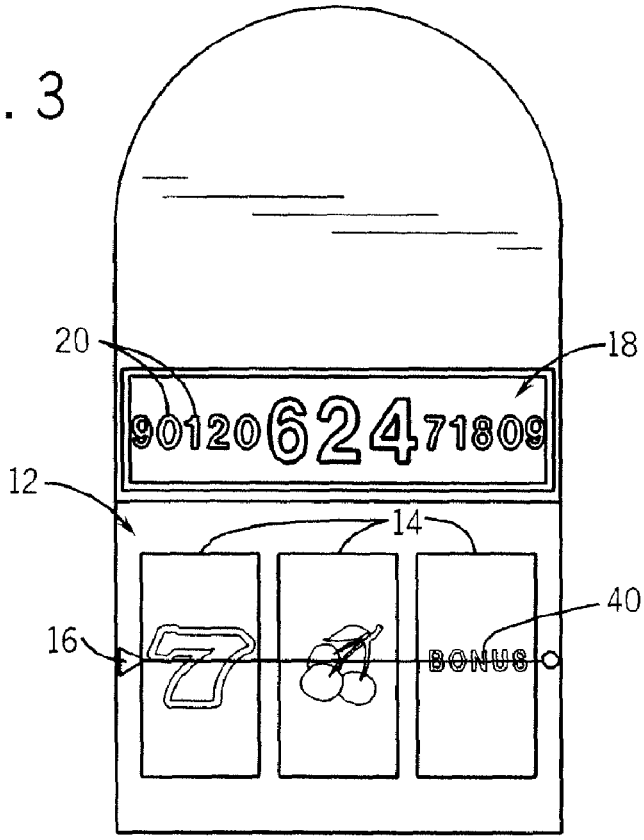

GAMING MACHINE WITH SCROLLING INDICIA FEATURE

CROSS REFERENCE TO RELATED APPLICATIONS

This application is a continuation of U.S. patent application Ser. No. 10/308,671, filed Dec. 3, 2002, which is herein incorporated by reference in its entirety.

FIELD OF THE INVENTION

The present invention relates generally to gaming machines and, more particularly, to a gaming machine including a scrolling indicia feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

To enhance the entertainment value of a gaming machine, gaming machines often include features such as an enhanced payoff and a "secondary" or "bonus" game which may be played in conjunction with a "basic" game. The bonus game may comprise any type of game, either similar to or completely different from the basic game, which is entered upon the occurrence of a selected event or outcome of the basic game. Generally, the features provide a greater expectation of winning than the basic game.

To attract players, more attractive or unusual video displays, mechanical/physical displays, and/or audio accompany the basic and bonus games. The fanciful and visually appealing displays offer tremendous advantages in player appeal and excitement relative to other known games. Additionally, such games are attractive to both players and operators. Thus, there is a continuing need to develop new features for the displays and the basic and bonus games to satisfy the demands of players and operators. Preferably, such new features will maintain, or even further enhance, the level of player excitement. The present invention is directed to satisfying these needs.

SUMMARY OF THE INVENTION

Accordingly, a gaming machine for conducting a wagering game includes a wagering apparatus, a display, and an award apparatus. The wagering apparatus receives a wager from a player. The display depicts a scrolled sequence of elements. The award apparatus provides an award based on an indicated portion of the sequence of elements. If the elements are digits, for example, the award may be based on a multi-digit number formed by the digits in the indicated portion of the sequence of elements. A method of conducting a wagering game on a gaming machine is also disclosed.

BRIEF DESCRIPTION OF THE DRAWINGS

The foregoing and other advantages of the invention will become apparent upon reading the following detailed description and upon reference to the drawings in which:

FIG. 2 is a block diagram of a control system suitable for operating the gaming machine;

FIGS. 3 through 5 are front views of the reel spinning and secondary displays of the gaming machine conducting the scrolling indicia feature.

Figure 1:
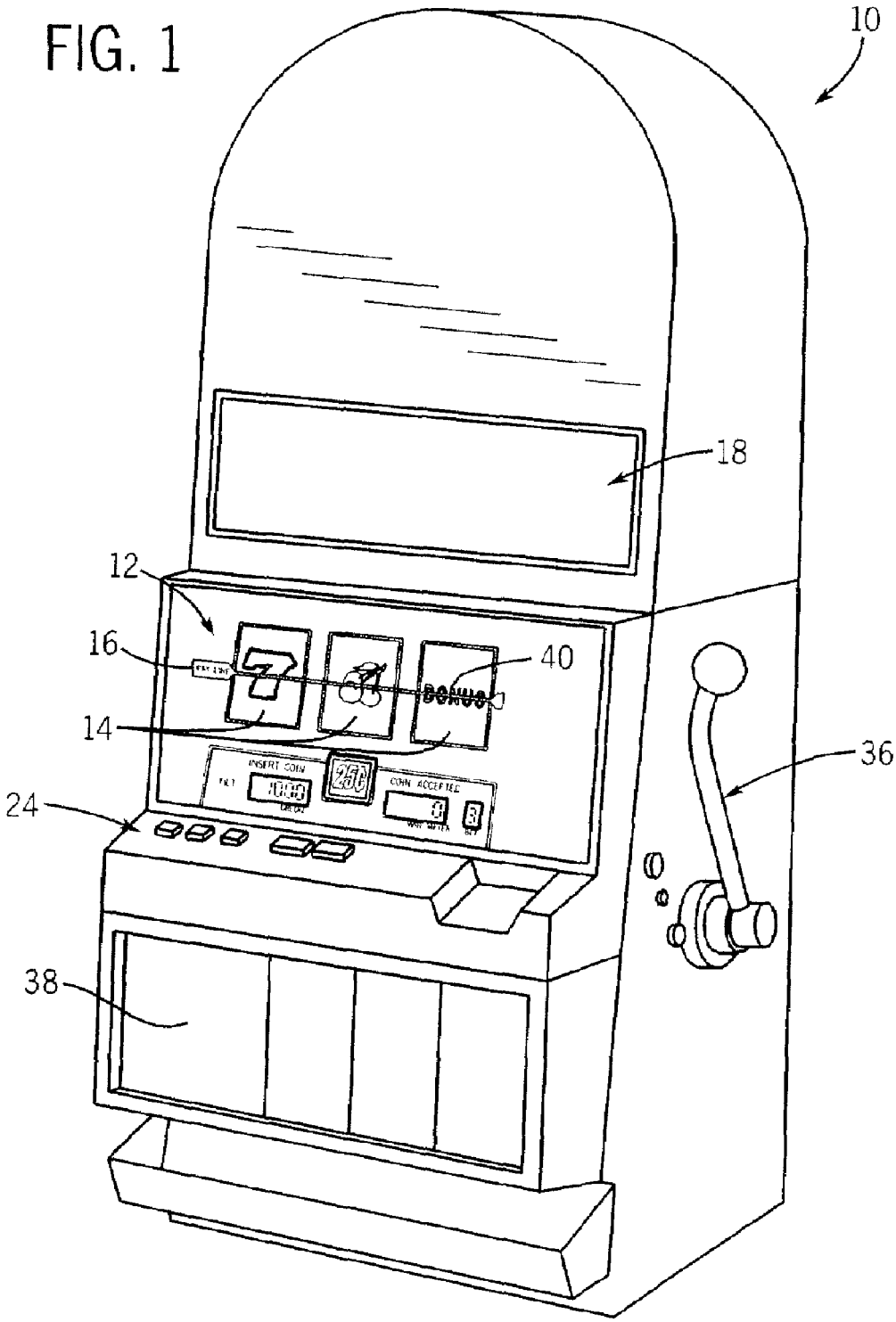
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings, FIG. 1 depicts a gaming machine 10 operable to conduct a slot-based wagering game. In operation, the gaming machine receives a wager from a player to purchase a "play" of the game. In a "play" of the game, the gaming machine generates at least one random event using a random number generator (RNG) and provides an award to the player for a winning outcome of the random event. To portray the random event to the player, the gaming machine includes a mechanical or video reel spinning display 12. The reel spinning display 12 includes a plurality of symbol-bearing reels 14 that are rotated and stopped to place symbols on the reels 14 in visual association with at least one pay line 16.

In addition to the reel spinning display 12, the gaming machine 10 includes a secondary display 18. While the machine is operating in a basic mode (as opposed to a bonus/feature mode), the display 18 may depict various types of information such as attract mode sequences, special effects, instructions, pay tables, game play elements, etc. While the machine is operating in a bonus mode, the display 18 depicts a scrolled sequence of elements such as digits as discussed below. The display 18 is preferably a video display, but may alternatively be a mechanical display in which the digits are printed on a moving strip or belt driven by a stepper motor.

Any video display employed in the gaming machine 10 may be implemented with a CRT, LCD, plasma, or other type of video display known in the art. The reel spinning display 12, especially if implemented in video, may be overlaid with a touch screen to facilitate interaction with the player. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

FIG. 2 is a block diagram of a control system suitable for operating the gaming machine. Money/credit detector 26 signals a central processing unit (CPU) 28 when a player has inserted money or played a number of credits. The money may be provided by coins, bills, tickets, coupons, cards, etc. Using a button panel 24 (see FIG. 1) or a touch screen 30, the player may select any variables associated with the slot-based wagering game (e.g., number of pay lines if more than one can be selected) and place his/her wager to purchase a play of the game. In a play of the game, the CPU 28 generates at least one random event using a random number generator (RNG) and provides an award to the player for a winning outcome of the random event. The CPU 28 operates the spinning reel display 12 and the secondary display 18 to represent the random event(s) and outcome(s) in a visual form that can be understood by the player. In addition to the CPU 28, the control system may include one or more additional slave control units for operating one or more of the displays 12 and 18.

A system memory 32 stores control software, operational instructions and data associated with the gaming machine. In one embodiment, the system memory 32 comprises a separate read-only memory (ROM) and battery-backed random-access memory (RAM). However, it will be appreciated that the system memory 32 may be implemented on any of several alternative types of memory structures or may be implemented on a single memory structure. A payoff mechanism 34 is operable in response to instructions from the CPU 28 to award a payoff to the player. The payoff may, for example, be in the form of a number of credits. The number of credits are determined by one or more math tables stored in the system memory 32.

The slot-based wagering game including a basic reel slot game and a scrolling indicia feature. The scrolling indicia feature is triggered by a start-bonus outcome in the basic slot game. Referring back to FIG. 1, to play the basic slot game, a player places a wager using a "bet one" key or a "max bet" key on the button panel 24. In response to pressing the "max bet" key, or a "spin reels" key for a wager less than the maximum, the CPU spins and randomly stops the plurality of symbol-bearing reels 14 to place symbols on the reels 14 in visual association with at least one pay line 16. Other mechanisms, such as a handle 36, may be used to set the reels 14 in motion. Additional pay lines may be provided, in which case the player is allowed to wager on more than one pay line. The number of illustrated reels is three but a different number of reels may be provided if desired. The display 12 on which the reels are implemented may be mechanical or video. If the display 12 is mechanical, the reels are physical and rotatably driven by stepper motors. If, however, the display 12 is video, the reels are simulated with moving graphics.

The CPU uses a random number generator to select a game outcome (e.g., "basic" game outcome) corresponding to a particular set of reel "stop positions." The CPU then causes each of the reels 14 to stop at the appropriate stop position. Symbols are displayed on the reels 14 to graphically illustrate the reel stop positions and indicate whether the stop positions of the reels 14 represent a winning game outcome.

Winning basic game outcomes (e.g., symbol combinations resulting in payment of coins or credits) are identifiable to the player by a pay table. The pay table may be printed on glass 38 mounted to the machine. A winning basic game outcome occurs when the symbols appearing on the reels 14 along the pay line 16 correspond to one of the winning combinations on the pay table. A winning combination, for example, could be three or more matching symbols along the pay line 16, where the award is greater as the number of matching symbols along the pay line 16 increases. If the displayed symbols stop in a winning combination, the game credits the player an amount corresponding to the award in the pay table for that combination multiplied by the number of wagered credits. The player may collect the amount of accumulated credits by pressing a "Collect" key on the button panel 24.

Included among the plurality of basic game outcomes is a start-bonus outcome for triggering play of a scrolling indicia feature. A start-bonus outcome may be defined in any number of ways. For example, a start-bonus outcome may occur when a special start-bonus symbol or a special combination of symbols appears on one or more of the reels 14. The start-bonus outcome may require the combination of symbols to appear along the pay line 16, or may alternatively require that the combination of symbols appear anywhere on the display regardless of whether the symbols are along the pay line 16. The appearance of the start-bonus outcome causes the CPU to shift operation from the basic slot game to the scrolling indicia feature. In the illustrated example, the start-bonus outcome consists of a BONUS symbol 40 along the pay line 16.

Figure 4:
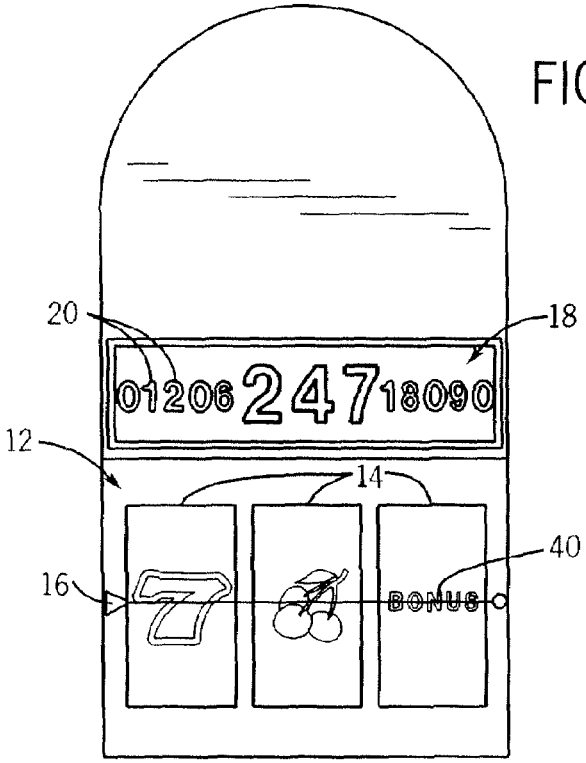
Figure 5:
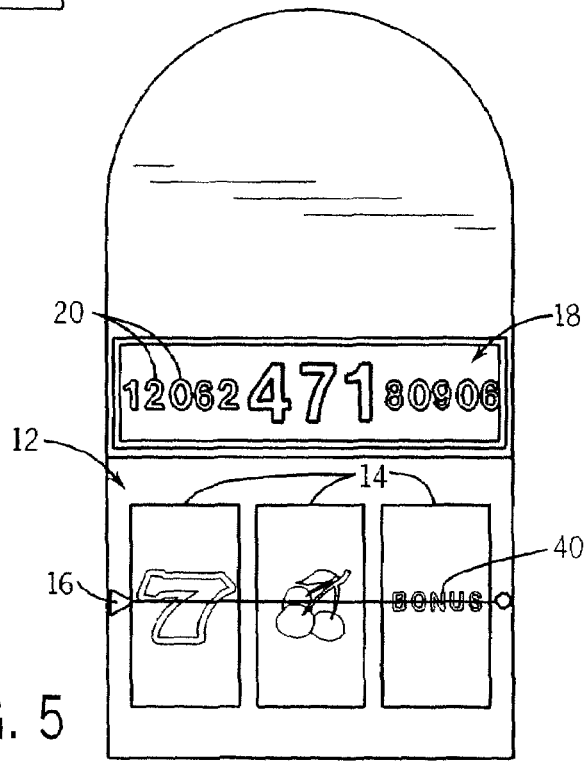

FIGS. 3, 4, and 5 depict the operation of the scrolling indicia feature. At the start of the scrolling indicia feature, a sequence of elements 20 begins to scroll across the display 18 from right to left (as illustrated) or left to right. The scrolling may begin automatically or in response to an action by the player (e.g., pressing a "start" button). The elements 20 may, for example, be digits ranging from 0 through 9. The elements 20 are preferably arranged in a repeating fixed sequence such that the first element in the sequence re-appears after the last element in the sequence. The CPU may randomly select the fixed sequence of elements 20 and the outcome of the scrolling indicia feature at the start of the scrolling indicia feature.

The number of elements 20 in the sequence is preferably far greater than the number visible on the display 18 at any given moment. For example, the number of elements 20 in the sequence may be twenty-seven (27), while the number visible on the display 18 at any given moment is thirteen (13). Therefore, only a part of the sequence of elements 20 is visible on the display 18 at any given moment. Alternatively, the entire sequence of elements 20 may be visible on the display 18 at any given moment.

A middle portion of the visible part of the sequence of elements 20 is associated with a possible award. This middle portion is displayed differently, e.g., larger, a different color, or highlighted in some other manner, from a remainder of the sequence. The number of elements 20 in the middle portion may, for example, be three (3) such that, at any given moment, the display 18 generally depicts a total of thirteen elements consisting of the three middle elements and a set of five elements on each side of the three middle elements.

The sequence of elements 20 may be scrolled across the display 18 in a linear or curvilinear manner. If scrolled in a linear manner as illustrated, the sequence of elements 20 may be scrolled horizontally as illustrated, vertically, diagonally, or some other direction or combination of directions. Furthermore, if the front surface of the display 18 is not flat, i.e., occupies three dimensions, the sequence of elements 20 may be scrolled across that surface to create other attractive and visual appealing presentations. The surface, for example, may be convex as shown in FIG. 6 or wavy.

Figure 6:
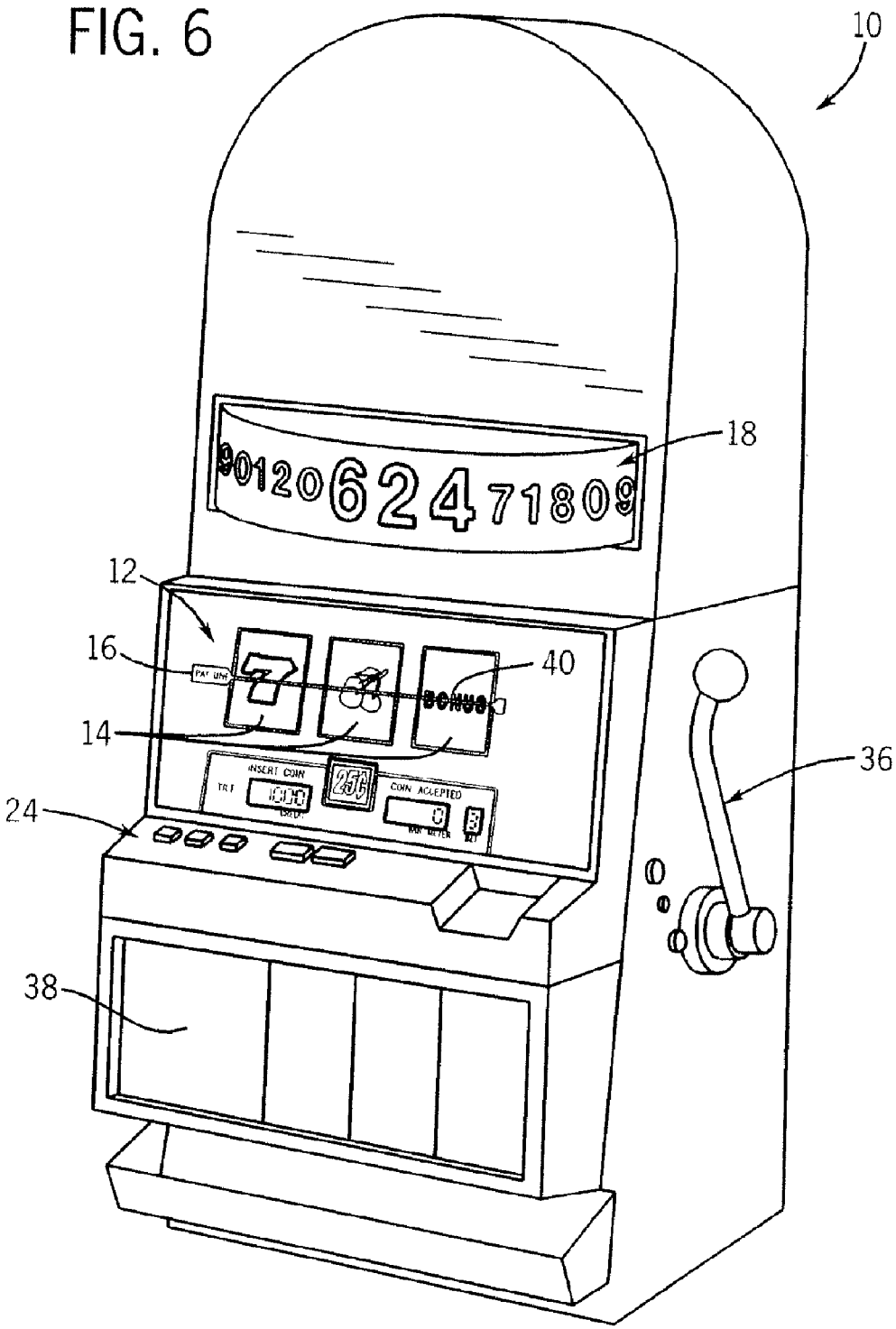
FIG. 6 is a perspective view of the gaming machine with an alternative secondary display.

If the elements 20 are digits, below is an illustrative sequence of digits and a template relating the sequence to the display 18 as the scrolling proceeds from FIG. 3, to FIG. 4, and finally to FIG. 5:

| TEM-PLATE: | Non-Visible Area | Visible Area | Possible Award | Visible Area | Non-Visible Area |
|---|---|---|---|---|---|
| FIG. 4: | 5 0 1 3 4 8 2 | 9 0 1 2 0 | **624** | 7 1 8 0 9 | 0 6 1 2 1 7 3 |
| FIG. 5: | 0 1 3 4 8 2 9 | 0 1 2 0 6 | **247** | 1 8 0 9 0 | 6 1 2 1 7 3 5 |
| FIG. 6: | 1 3 4 8 2 9 0 | 1 2 0 6 2 | **471** | 8 0 9 0 6 | 1 2 1 7 3 5 0 |

Referring to FIG. 3, the display 18 depicts the string "9 0 1 2 0 6 2 4 7 1 8 0 9". The middle three digits, "6 2 4", are displayed differently from the other digits.

Referring to FIG. 4, after the digits 20 have scrolled from right to left by one digit position, the display 18 depicts the string "0 1 2 0 6 2 4 7 1 8 0 9 0". Again, the middle three digits, "2 4 7", are displayed differently from the other digits.

Referring to FIG. 5, after the digits 20 have scrolled from right to left by another digit position, the display 18 depicts the string "1 2 0 6 2 4 7 1 8 0 9 0 6". Again, the middle three digits, "4 7 1", are displayed differently from the other digits.

The scrolling indicia feature provides an award based on the portion of the sequence that is displayed differently (e.g., larger and a different color) when the scrolling stops. The sequence of elements 20 preferably scrolls across the display 18 for one or more iterations of the sequence so that each element of the sequence appears at least once on the display 18. For the sake of simplicity of explanation, however, suppose the scrolling stops with the three digits, "4 7 1", in FIG. 5 yielding the award. If the elements 20 are digits as illustrated, the award may be based on a multi-digit number formed by the middle three digits and, more specifically, may be a credit amount (e.g., 471 credits) corresponding to this number. Alternatively, the award may be based on an arithmetic expression including the middle three digits, such as addition of the digits (e.g., 12 credits=4+7+1) or multiplication of the digits (e.g., 28 credits=4×7×1). In another alternative embodiment, arithmetic symbols such as +, –, and × are interleaved between the digits and the award is based on the result of the arithmetic expression (e.g., 29 credits=4×7+1).

The elements 20 of the sequence may take forms other than the illustrated digits, including but not limited to symbols, playing cards, shapes, puzzle pieces, colors, or other indicia. If the elements 20 are symbols, for example, the award may be based on the middle three symbols and the number which match each other. The symbols may be thematic symbols or such traditional reel symbols as 7, 1bar, 2bar, 3bar, bell, cherry, and/or various fruits. If the elements 20 are playing cards, the award may be based on the middle three playing cards and the rank of the poker hand created with the three cards.

The rate at which the sequence of elements 20 scrolls across the display 18 may be controlled to create a sense of anticipation and excitement. For example, the rate of scrolling may be gradually increased to a fixed velocity, maintained at the fixed speed for a few seconds, and then gradually decreased until stopping the scrolling altogether. Alternatively, the rate of scrolling may fluctuate several times between increasing and decreasing to further tease the player.

While the present invention has been described with reference to one or more particular embodiments, those skilled in the art will recognize that many changes may be made thereto without departing from the spirit and scope of the present invention. For example, the number of elements 20 used in determining the award may vary from the illustrated example which uses three elements. If the elements 20 are playing cards, for example, the number of playing cards used in determining the award may be five as in a traditional poker hand. Each of these embodiments and obvious variations thereof is contemplated as falling within the spirit and scope of the claimed invention, which is set forth in the following claims.

What is claimed is:

1. A method of conducting a wagering game on a gaming machine, comprising:

receiving a wager from a player;

scrolling a sequence of digits in a predetermined direction across a display; and providing an award based on a multi-digit number formed by a subset of the sequence of digits, the digits in the subset being oriented along the predetermined direction, wherein the award is of a first amount if a digit within the subset is disposed in a first position within the subset and is of a second different amount if the same digit is disposed in a second position within the subset, wherein only a part of the sequence of digits is visible on the display at any given moment.

2. The method of claim 1, wherein the display is a video display.

3. The method of claim 1, wherein the display is a mechanical display.

4. The method of claim 1, wherein all of the sequence of digits is visible on the display.

5. The method of claim 1, wherein the multi-digit number is displayed differently from a remainder of the sequence of digits.

6. The method of claim 5, wherein the multi-digit number is larger than the remainder of the sequence of digits.

7. The method of claim 5, wherein the multi-digit number is a different color than the remainder of the sequence of digits.

8. The method of claim 1, wherein the sequence of digits is scrolled in a linear manner.

9. The method of claim 1, wherein the sequence of digits is scrolled in a curvilinear manner.

10. The method of claim 1, wherein the award is based on a arithmetic expression including the digits in the multi-digit number.

11. The method of claim 10, wherein one or more arithmetic symbols are interleaved between the digits in the multi-digit number.

12. The method of claim 1, wherein the multi-digit number is a credit value that is provided as the award.

13. A gaming machine for conducting a wagering game, comprising:

a wagering apparatus for receiving a wager from a player;

a display for displaying a scrolled sequence of digits, the sequence of digits being scrolled in a predetermined direction; and an award apparatus for providing an award based on a subset of the sequence of digits, the digits in the subset being oriented along the predetermined direction, wherein the award is of a first amount if the subset captures a digit in a first position within the subset and is of a second different amount if the subset captures the same digit in a second different position within the subset, wherein only a part of the sequence of digits is visible on the display at any given moment.

14. The gaming machine of claim 13, wherein the display is a video display.

15. The gaming machine of claim 13, wherein the display is a mechanical display.

16. The gaming machine of claim 13, wherein all of the sequence of digits is visible on the display.

17. The gaming machine of claim 13, wherein the portion of the sequence of digits is displayed differently from a remainder of the sequence of digits.

18. The gaming machine of claim 17, wherein the portion of the sequence of digits is larger than the remainder of the sequence of digits.

19. The gaming machine of claim 17, wherein the portion of the sequence of digits is a different color than the remainder of the sequence of digits.

20. The gaming machine of claim 13, wherein the sequence of digits is scrolled in a linear manner.

21. The gaming machine of claim 13, wherein the sequence of digits is scrolled in a curvilinear manner.

22. The gaming machine of claim 13, wherein the award is based on a arithmetic expression including the digits in the portion of the sequence of digits.

23. The gaming machine of claim 13, wherein one or more arithmetic symbols are interleaved between the digits in the portion of the sequence of digits.

24. The gaming machine of claim 13, wherein the portion of the sequence of digits is a credit value that is provided as the award.

25. A gaming machine for conducting a wagering game, comprising:

a wagering apparatus for receiving a wager from a player;

a display for displaying a scrolled sequence of digits, the sequence of digits being scrolled in a predetermined direction; and an award apparatus for providing an award based on a subset of the sequence of digits, the digits in the subset being oriented along the predetermined direction, wherein a digit within the sequence is able to appear in different positions within the subset, the award varying depending upon the position of the digit within the subset, wherein only a part of the sequence of digits is visible on the display at any given moment.

* * * * *